United States Patent [19]

Betts et al.

[11] 3,956,908

[45] May 18, 1976

[54] KNITTING METHOD

[75] Inventors: Max William Betts, Coventry; Frank Robinson, Derby, both of England

[73] Assignee: Courtaulds Limited, London, England

[22] Filed: Jan. 20, 1975

[21] Appl. No.: 542,591

[30] Foreign Application Priority Data

Feb. 5, 1974 United Kingdom ..... 5227/74

[52] U.S. Cl. ..... 66/175; 66/70

[51] Int. Cl.[2] ..... A41B 9/08

[58] Field of Search ..... 66/175, 176, 64, 67, 66/70, 73, 76

[56] References Cited

UNITED STATES PATENTS

| | | | |
|---|---|---|---|
| 3,474,643 | 10/1969 | Robinson et al. | 66/176 X |
| 3,636,733 | 1/1972 | Betts et al. | 66/176 |
| 3,640,097 | 2/1972 | Betts et al. | 66/176 |
| 3,664,156 | 5/1972 | Betts et al. | 66/176 |
| 3,668,901 | 6/1972 | Betts et al. | 66/176 |
| 3,695,063 | 10/1972 | Betts et al. | 66/176 |
| 3,702,068 | 11/1972 | Betts et al. | 66/176 |

*Primary Examiner*—Ronald Feldbaum

*Attorney, Agent, or Firm*—Davis, Hoxie, Faithfull & Hapgood

[57] ABSTRACT

A knitted sleeved garment is made from a blank comprising sleeves and body joined together on the knitting machine by sleeve and body shoulder portions knitted integral with one another and formed with wales of different lengths by taking successive needles out of action during knitting of the shoulder portions and reintroducing those needles in opposite sequence to cause the sleeves to lie at an angle to the body. The shoulder portions extend only part way from the arm pits of the blank to the neck and a shoulder region of the blank adjacent the neck is formed by extensions of the body shoulder portion and/or sleeve shoulder portions.

8 Claims, 8 Drawing Figures

KNITTING METHOD

Figure 1:
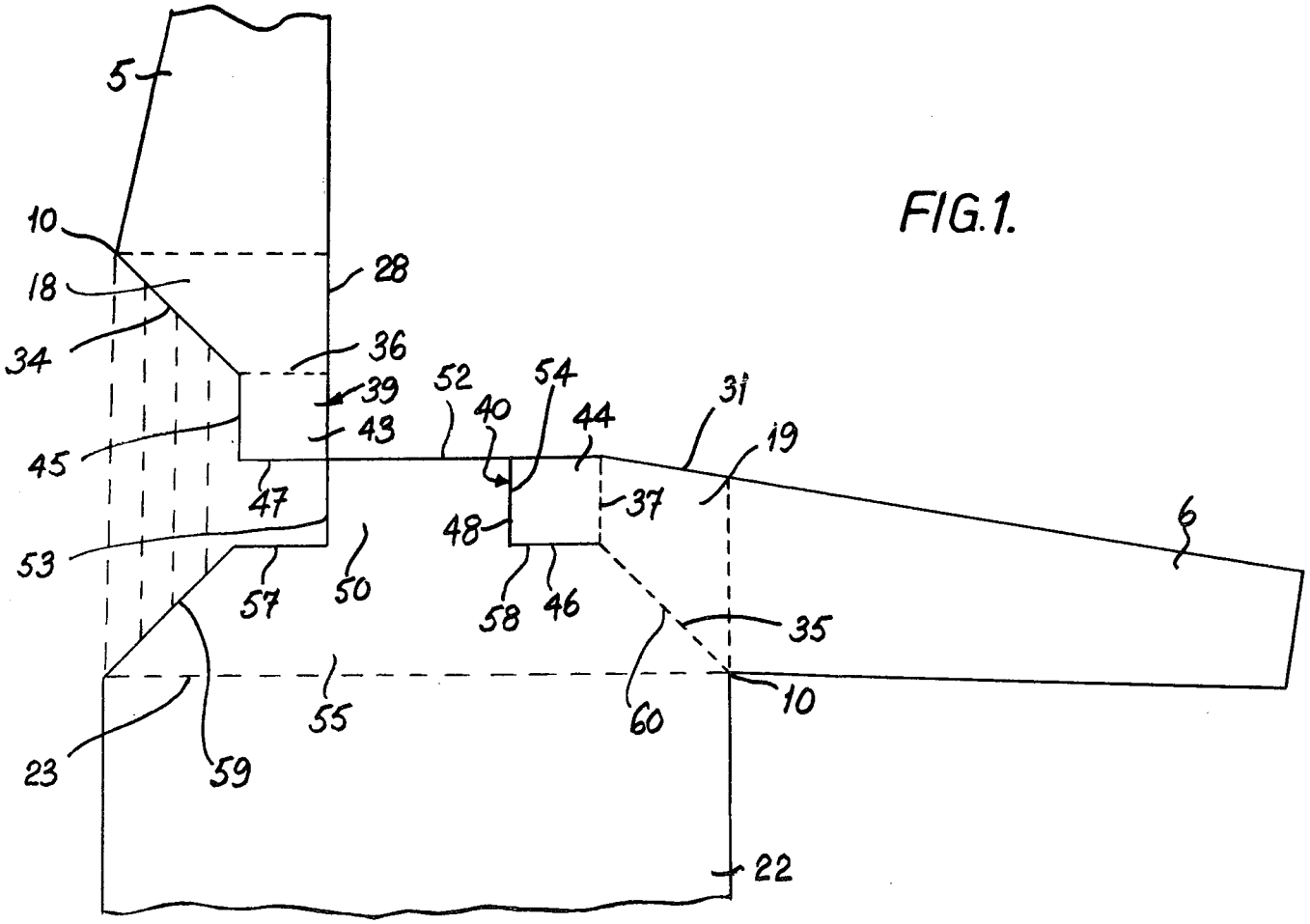

This invention relates to knitted garments having sleeves.

Hitherto such garments have normally been made commerically by one of two methods. In one of these methods, flat or tubular knitted fabric is cut into shapes which are secured together, usually by stitching, to form the garment. In the other method, the component pieces of a garment are knitted to shape and are then secured together to make the garment.

In both these methods considerable labour is involved in "making up" the garment and in the first method a considerable quantity of fabric is cut to waste, sometimes 40% of the the total fabric used.

By following the present invention, the amount of making up involved in the production of a sleeved garment compared with the known methods outlined above is reduced because the sleeves and body of the garment are produced in the same operation on the same knitting machine and leave the knitting machine already joined together.

A method of knitting a sleeved garment in one piece is disclosed in British Patent Specification No. 1,265,308. In that method, the garment sleeves are knitted in the direction from the cuffs to the under-arm region, shoulder portions of the garment are then knitted continuing from the under-arm region in reciprocatory manner on both beds of a pair of opposed beds of the machine such that pieces of the shoulder region on the two beds are joined together at the edge of the sleeve which is innermost on the machine and needles are successively made inactive in an inwards direction from both ends of the needle beds. Subsequently front and rear upper body portions of the garment are knitted as flat fabric on a pair of opposed beds of the machine in the direction towards the lower end of the body and in the knitting of these body portions inactive needles carrying stitches of the shoulder portions are brought back into action, and finally the remainder of the body is knitted to the lower end.

In a later development of the method of British Patent Specification No. 1,265,308, the garment is started at the waist and is knitted in the direction towards the cuffs of the sleeves.

In the method of British Patent Specification No. 1,265,308 and in the later development, the sleeves are completely joined to the body during knitting of the garment and the methods are thus capable of very little variation in garment style. One of the aims of the present invention is to enable greater variation to be achieved in the garment style than was possible with the method of British Patent Specification No. 1,265,308.

According to one aspect of the invention, a method of knitting a blank for a sleeved garment on opposed beds of a knitting machine comprises the steps, in either order, of knitting two sleeves for the garment and knitting a body for the garment, and also comprises the step of joining the sleeves to the body on the knitting machine by knitting integral shoulder portions of the garment sleeves and the garment body, the shoulder portions extending from the arm pit regions of the blank part way to the neck, and during knitting of the shoulder portions making successive needles inactive in an inwards direction from the outer edges of the garment on the needle beds, and then reintroducing the inactive needles in opposite sequence to cause the sleeve to lie at an angle to the body in the finished garment, and also knitting extensions from each sleeve shoulder portion and/or the body shoulder portion to form a part of a shoulder region of the garment adjacent the neck.

According to another aspect of the invention, a knitted blank for a sleeved garment comprises two sleeves and a body joined together by integral sleeve and body shoulder portions having wales of different lengths formed by taking successive needles out of action whilst knitting the shoulder portions and reintroducing those needles to cause the sleeves to lie at an angle to the body, the sleeve and body shoulder portions extending part way from the arm pit regions of the blank to the neck and the blank including extensions from each sleeve shoulder portion and/or the body shoulder portion forming part of a shoulder region of the garment adjacent the neck.

The invention also includes a garment made from the blank just described by steps including joining the said extensions to one another and/or to the body and/or sleeves.

The extensions may be extensions of the body shoulder portion constituting the whole of the central part of the shoulder region of the garment and each sleeve shoulder portion may have end edges, running course-wise, and positioned for joining to side edges, running wale-wise, of the said extensions.

The extensions may comprise an extension from each sleeve shoulder portion and front and rear extensions from the body shoulder portion, an end edge, running course-wise of each sleeve shoulder portion extension being positioned for joining to a side-edge, running wale-wise, of a body shoulder portion extension, and a side edge, running wale-wise, of each sleeve shoulder portion extension being positioned for joining to an end edge, running course-wise, of a body shoulder portion.

Figure 2:
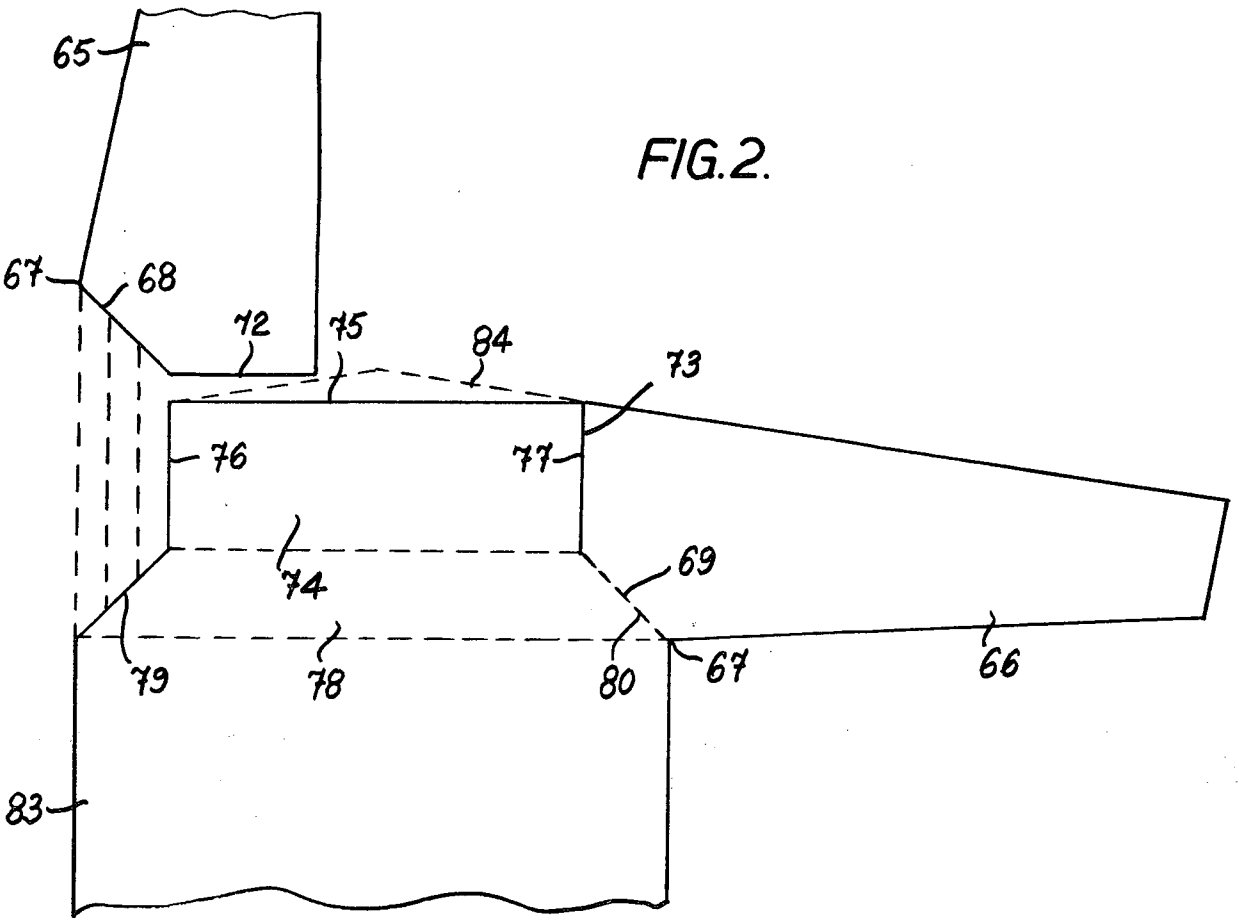

The invention will be further described, by way of example, with reference to the accompanying drawings, in which:

FIG. 1 is a diagrammatic view of a sleeved garment according to the invention, illustrating its method of manufacture, FIG. 2 is a view similar to FIG. 1 of another garment according to the invention, and FIGS. 3A to 3F are a series of schematic diagrams of a flat V-bed knitting machine showing stages in the knitting of the garment of FIG. 1.

The knitting of the garments shown in the drawings can be carried out on a flat V-bed knitting machine of the kind comprising at least one pair of opposed needle beds, a reciprocating head with cam tracks to cooperate with the butts of needles slidably mounted in grooves or tricks in the needle beds for operating the needles independently of each other, and a plurality of yarn carriers to supply yarn for the production of knitted loops of yarn on needles which are operated by the reciprocating head for the purpose.

The machine can be substantially conventional in construction but is preferably equipped with a hold-down element, for example a hold-down element like that described in British Patent Specification No. 1,288,043, in place of conventional take-down rollers. Such a hold-down element facilitates the carrying out of knitting procedures in which knitting is carried on on some needles whilst adjacent needles are maintained out of action but still retain knitted loops on them.

The number of needles and knitted loops shown in each of FIGS. 3A to 3F is purely illustrative, a much smaller number of loops being shown than would be found in a normal garment in order to simplify the drawing.

Figures 3A, 3B, 3C, 3D, 3E, 3F:
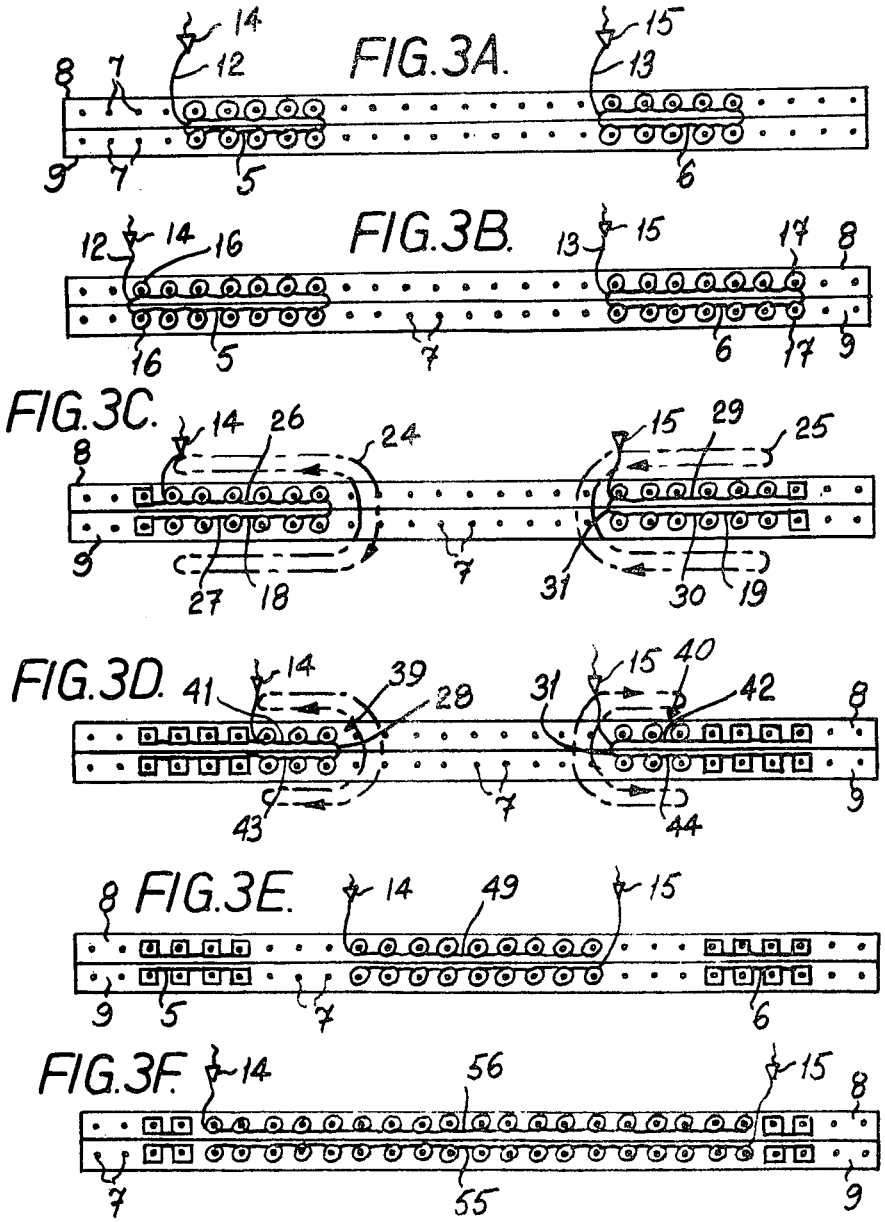

FIG. 3A shows an early stage in the knitting of the garment of FIG. 1. At the stage shown in FIG. 3A, the knitting of the sleeves of the garment has been commenced. The start-up in knitting the sleeves is carried out in a conventional manner, and, if desired, a conventional mock-rib structure can be used for knitting the cuffs of the sleeves to give the cuffs a ribbed appearance. Since the start-up and the mock-rib structure are known and conventional and in themselves form no part of the present invention no detailed description of them will be given in this specification. The sleeves are knitted in tubular form so that after the knitting is completed no seaming of the sleeves is required.

FIG. 3A shows stitches of the two sleeves 5 and 6 carried on needles 7 of two opposed beds 8 and 9 of a flat V-bed knitting machine. Yarns 12 and 13 are supplied to the tubular sleeves 5 and 6 by separate yarn carriers 14 and 15. Knitting of the sleeves is continued by conventional tubular knitting up to the arm pit level and widening of the sleeves is carried out during knitting by means of needle introduction in conventional manner. The situation at the arm pit level 10 of the sleeves is illustrated in FIG. 3B. The tubular sleeves 5 and 6 are so positioned on the needle beds 8 and 9 that the number of needles from the outermost needles 16 carrying stitches of the tubular sleeve 5 to the outermost needles 17 carrying stitches of the tubular sleeve 6 is equal to the number of needles required to knit the body 22 of the garment at the arm pit level 23 in the body (FIG. 1).

Knitting of the two sleeves continues from the stage illustrated in FIG. 3B by knitting of shoulder portions 18 and 19 of the sleeves 5 and 6 respectively, employing reciprocatory knitting as illustrated in FIG. 3C. The chain lines 24, 25 in FIG. 3C indicate the paths of the yarn carriers 14 and 15 during this reciprocatory knitting which produces two sets of U-shaped courses (one set in each sleeve), the closed end of each U-shaped course being at the edge of the sleeve lying closer to the other sleeve and the open end of each U-shaped course being at the edge of the sleeve which is outermost on the needle beds, remote from the other sleeve. The shoulder portion 18 of the sleeve 5 thus comprises pieces of fabric 26 and 27 on the opposed beds 8 and 9 of the knitting machine respectively, these pieces of fabric being joined at the edge 28 (FIG. 1) of the sleeve 5 which is innermost on the beds. Similarly, the shoulder portion 19 of the sleeve 6 comprises two pieces of fabric 29 and 30 on the opposed needle beds 8 and 9 respectively, these pieces of fabric being joined at the edge 31 of the sleeve 6 which is innermost on the needle beds.

As the knitting of the shoulder portions 18 and 19 progresses, the number of needles involved in knitting the shoulder portions is gradually reduced by taking needles out of action successively starting from the outermost active needles and proceeding in an inwards direction from both ends of the needle beds. In FIG. 3C, this process has been started and the needles 16 and 17 have been taken out of action. This is indicated by showing the loops, which are still retained on the inactive needles, as square shapes.

At the stage in the knitting just before completion of the shoulder portions 18 and 19 of the sleeves 5 and 6 more needles have been made inactive whilst still carrying their loops. When the two shoulder portions 18 and 19 have been completed, the stitches in the join lines 34 and 35 (FIG. 1) and the stitches in the corresponding join lines of the pieces of fabric at the rear of the sleeves, as seen in FIG. 1, are held on inactive needles and the stitches in the final courses 36 and 37 of the shoulder portions 18 and 19 are held on the needles which have just knitted those courses.

The knitting machine is next operated to knit sleeve shoulder portion extensions 39 and 40 using reciprocatory knitting to form U-shaped courses so that each extension comprises a piece of fabric 41 or 42 on the needle bed 8 and a piece of fabric 43 or 44 on the needle bed 9 and these pieces of fabric are joined at the edges 28 and 31 of the sleeves which are innermost on the needle beds. This stage of the knitting operation is shown in FIG. 3D.

Each piece of fabric 41, 42, 43 and 44 is rectangular in shape. The free edges of the pieces of fabric 43 and 44 each comprise a line 45 or 46 along a wale and a line 47 or 48 along a course (FIG. 1) and the free edges of the pieces of fabric 41 and 42 also comprise lines along courses or wales.

When the sleeve shoulder portion extensions 39 and 40 constituted by pieces of fabric 41, 42, 43 and 44 have been completed, their stitches are cast off the needles and the knitting of two pieces of fabric constituting extensions 49 and 50 of the body shoulder portion is commenced. The extension 50 knitted on needle bed 9 is shown in FIG. 1 and this stage of knitting is illustrated in FIG. 3E. The stitches of the sleeves 5 and 6 held on needles taken successively out of action are still held on those needles and those needles remain inactive during this stage of the knitting operation. Knitting of the extensions 49 and 50 may be commenced by a course of rib knitting involving combined use of needles on both needle beds 8 and 9, followed by separate knitting on bed 8 and bed 9 of the two body shoulder portion extensions. Alternatively knitting of the two extensions 49 and 50 may be commenced and continued separately. Both body shoulder portion extensions are knitted to the shape shown in FIG. 1 in respect of the extension 50. The extension 50 is rectangular with one edge 52 extending along a course and other edges 53 and 54 extending along wales.

On completion of the extensions 49 and 50, further needles of both beds located at both sides of the needles used to knit the extensions 49 and 50 are brought into operation simultaneously and are supplied with yarn to commence knitting of shoulder portions 55 and 56 of the body 22. Thus, end edges 57 and 58 of the body 22 extending course-wise of the body 22 are produced. During knitting of the shoulder portions 55 and 56, inactive needles holding stitches of the sleeves 5 and 6 are brought progressively back into action in opposite sequence to that in which they were taken out of action and are supplied with yarn so that the shoulder portions 55 and 56 are gradually widened during knitting and are joined to the sleeves 5 and 6 along join lines 59 and 60 at front and rear of the garment. This stage of knitting is illustrated in FIG. 3F. In FIG. 1, the sleeve 5 is shown in the attitude in which it is knitted and the joining of this sleeve to the body 22 is indicated by broken lines, whereas the sleeve 6 is shown in the attitude it takes up in relation to the body 22 in the finished garment after removal of the garment blank from the knitting machine. The sleeve 6 thus lies at an acute angle to the body 22.

After completion of the shoulder portions 55 and 56 of the body, when all the inactive needles holding sleeve stitches have been brought back into operation, knitting of the body 22 is continued using tubular knitting so as to form the main part of the body as a tube needing no seaming. The body may be finished at the waist with a known mock rib structure, if desired, before the garment blank is cast off the needles.

To complete the garment, the sleeve shoulder portion extensions 39 and 40 are joined to the body 22 and to the body shoulder portion extensions 49 and 50. An end edge, running course-wise, of each sleeve shoulder portion extension is joined to a side edge running wale-wise of each body shoulder portion extension and a side edge running wale-wise of each sleeve shoulder portion extension is joined to an end edge running course-wise of the body. In FIG. 1, the side edge 46 of the piece of fabric 44 of the extension 40 is shown joined to the end edge 58 of the body and the end edge 48 of the extension 40 is shown joined to the side edge 54 of the extension 50. The side edge 45 of the extension 39 will, in the finished garment, be joined to the end edge 57 of the body 22 and the end edge 47 of the extension 39 will be joined to the side edge 53 of the extension 50. The other edges of the extensions 39 and 40, not visible in FIG. 1, will be similarly joined to corresponding edges of the body and body shoulder portion extensions in the finished garment.

The joining of the sleeve shoulder portion extensions to the body and to the body shoulder portion extensions can be carried out by conventional seaming or linking methods.

The garment produced by the procedure described above has an appearance similar to a conventional saddle shoulder garment.

The knitting procedure can also be carried out starting at the waist of the body and knitting towards the cuffs of the sleeves, the extensions 49 and 50 being knitted before the extensions 39 and 40.

The garment illustrated in FIG. 2 was knitted on the same knitting machine as the garment illustrated in FIG. 1. The knitting can be commenced at the cuffs of the sleeves 65 and 66, the sleeves being knitted simultaneously in the form of tubes and widened as desired during knitting by conventional techniques of needle introduction. When the arm pit position 67 is reached in both sleeves, knitting is continued to form the shoulder portions of the sleeves. Needles are taken out of action successively on both needle beds (whilst still holding their stitches) starting at the outermost needles on the needle beds holding stitches of the sleeves. This part of the knitting procedure is similar to that illustrated in FIGS. 3A, 3B and 3C in respect of the garment in FIG. 1, reciprocatory knitting producing U-shaped courses being employed. In the present instance, however, fewer needles are rendered inactive than in the garment of FIG. 1.

When, by this procedure, the shaping lines 68 and 69 have been completed, the remaining needles holding sleeve stitches are operated to cast off their stitches. These stitches are located along the lines 72 and 73 extending course-wise at the ends of the sleeves. Because the shoulder portions of the sleeves are knitted using U-shaped courses, the lines 72 and 73 extend to the back and front of the garment and only that part of each line produced on needles of one of the needle beds is visible in FIG. 2.

Knitting of two body shoulder portion extensions 74, only one of which can be seen in FIG. 2, is now commenced. One extension 74 is knitted on each of the opposed needle beds of the machine and they may be started independently on the two beds or a course of rib knitting using needles of both beds may be knitted at the start of the extensions. Each extension 74 comprises a rectangular panel as shown in FIG. 2 having an edge 75 extending along a course and side edges 76 and 77 extending along wales.

On completion of the extensions 74, knitting is continued to form the shoulder portions 78 of the body, only one of which is visible in FIG. 2. During knitting of the shoulder portions 78, inactive needles holding stitches are progressively reintroduced in opposite sequence to that in which they were taken out of action, thus shaping the shoulder portions along lines 79 and 80. The shoulder portions of the sleeves and body are, of course, integrally joined to one another along the lines 68, 79 and 69, 80 by the knitting procedure.

The shaping of the shoulder portions of the body and sleeves by the procedure described causes the sleeves to lie at an acute angle to the body in the finished garment.

On completion of the shoulder portions 78, knitting is continued to form the body 83 as a tube requiring no further seaming.

A known technique of tubular knitting is used in which yarn supplied from one yarn feeder forms stitches on needles of the bed 8 and on the same traverse of the needle beds by the cam box yarn from another yarn feeder forms stitches on needles of the bed 9. On the next cam box traverse in the opposition direction, the yarn feeders supply yarn to needles of the bed opposite to the one containing the needles they supplied in the previous traverse. This change-over of yarn supply takes place after each traverse of the cam box and enables the two opposite sides of the tube to be formed at the same time, the tubular shape being produced by the cross-over of yarn at the end of each traverse.

At the waist the knitting is finished in known manner and the garment blank is cast off the needles.

The garment blank of FIG. 2 can also be knitted in the resverse direction starting at the waist of the body and knitting to the cuffs of the sleeves. The body shoulder portion extensions 74 are then knitted and cast off the needles before knitting of the sleeves is commenced.

To make a garment from the garment blank of FIG. 2, the end edges 72 and 73 of the sleeves 65 and 66 are joined to the side edges 76 and 77 of the extensions 74 and the upper edges of extensions 74 are joined together if not already joined by a rib start-up for the extensions. Conventional seaming or linking techniques can be used.

If desired, the upper edges of the extensions 74 may be shaped as shown by the broken line 84 in FIG. 2 in order to give the garment a sloping shoulder style. The shaping is carried out by conventional techniques of needle introduction, if knitting the blank in the direction from cuff to waist and by taking needles out of action and casting off their loops if knitting the blank in the opposite direction.

What is claimed is:

1. A method of knitting a blank for making up into a sleeved garment, said method being carried out on two opposed needle beds of a knitting machine and comprising, in either order, the steps of a. knitting two sleeves for the garment and b. knitting a body for the garment, said method also comprising the steps of c. joining the sleeves to the body on the knitting machine by knitting integral shoulder portions of the garment sleeves and integral shoulder portions of the garment body, said shoulder portions extending from the arm pit regions of the blank part way to the neck, and during knitting of the shoulder portions making successive needles inactive in an inwards direction from the outer eges of the garment on the needle beds, and then reintroducing the inactive needles in opposite sequence thereby causing the sleeves to lie at an angle to the body in the finished garment, and d. knitting extensions from at least each sleeve shoulder portion to form a part of a shoulder region of the garment adjacent the neck.

2. A method of knitting a blank for making up into a sleeved garment, said method being carried out on two opposed needle beds of a knitting machine and comprising, in either order, the steps of a. knitting two sleeves for the garment and b. knitting a body for the garment, said method also comprising the steps of c. joining the sleeves to the body on the knitting machine by knitting integral shoulder portions of the garment sleeves and integral shoulder portions of the garment body, said shoulder portions extending from the arm pit regions of the blank part way to the neck, and during knitting of the shoulder portions making successive needles inactive in an inwards direction from the outer edges of the garment on the needle beds, and then reintroducing the inactive needles in opposite sequence thereby causing the sleeves to lie at an angle to the body in the finished garment, and d. knitting extensions from the body shoulder portion to form part of a shoulder region of the garment adjacent the neck.

3. A method as claimed in claim 1 wherein said extensions are knitted to comprise a. an extension from each sleeve shoulder portion and b. extensions at the front and rear of the body shoulder portion and wherein said extensions are further knitted so that c. each sleeve shoulder portion extension has an end edge running course-wise and a side edge running wale-wise and d. each body shoulder portion extension has a side edge running wale-wise, and wherein the body of the garment blank is knitted so that it has e. upper end edges running course-wise, each of said end edges of the sleeve shoulder portion extensions being positioned in the garment blank of joining to one of said side edges of the body shoulder portion extensions, and each of said side edges of the sleeve shoulder portion extensions being positioned in the garment blank for joining to one of said end edges of the body shoulder portion.

4. A method as claimed in claim 2 wherein a. said extensions are knitted to comprise the whole of the central part of the shoulder region of the garment and to have side edges running wale-wise and b. each sleeve shoulder portion is knitted to have end edges running course-wise and each of said side edges of the extensions is positioned in the garment blank for joining to one of said end edges of the sleeve shoulder portions.

5. A knitted sleeved garment made up from a garment blank, said blank comprising a. two sleeves b. a body c. integral sleeve shoulder portions and body shoulder portions joining said sleeves to said body, said shoulder portions extending from arm pit regions of the blank part way to the neck and having wales of different lengths formed by making successive needles inactive and then reintroducing those needles in opposite sequence during knitting of said shoulder portions to cause said sleeves to lie at an angle to the body in the finished blank, and d. extensions integral at least with said sleeve shoulder portions and forming part of the shoulder region of the garment adjacent the neck.

6. A knitted sleeved garment made up from a garment blank, said blank comprising a. two sleeves b. a body c. integral sleeve shoulder portions and body shoulder portions joining said sleeves to said body, said shoulder portions extending from arm pit regions of the blank part way to the neck and having wales of different lengths formed by making successive needles inactive and then reintroducing those needles in opposite sequence during knitting of said shoulder portions to cause said sleeves to lie at an angle to the body in the finished blank, and d. extensions integral at least with said body shoulder portion and forming part of the shoulder region of the garment adjacent the neck.

7. A garment as claimed in claim 5 made up from a blank which further comprises extensions integral with the front and rear of said body shoulder portion, each of said sleeve shoulder portion extensions having an end edge running course-wise and a side edge running wale-wise, each of said body shoulder portion extensions having a side edge running wale-wise and said body shoulder portion having end edges running course-wise, said end edge of each sleeve shoulder portion extension being positioned in the blank for joining to one of said side edges of a body shoulder portion extension and said side edge of each sleeve shoulder portion extension being positioned in the blank for joining to one of said end edges of the body shoulder portion.

8. A garment as claimed in claim 6 wherein said extensions in said blank constitute the whole of a central part of the shoulder region of the garment, said sleeve shoulder portions have end edges running course-wise and said extensions have side edges running wale-wise, said sleeve shoulder portion end edges being positioned in the blank for joining to said extension side edges.

* * * * *